United States Patent [19]

Dyson et al.

[11] Patent Number: 4,504,241

[45] Date of Patent: Mar. 12, 1985

[54] TOY FIGURE WITH MANUALLY OPERABLE INGESTION SYSTEM

[75] Inventors: Lewis R. Dyson, Milford, Ohio; Dan B. Young, Hebron, Ky.; Stuart A. Cook, New Richmond, Ohio

[73] Assignee: CPG Products Corp., Minneapolis, Minn.

[21] Appl. No.: 464,079

[22] Filed: Feb. 4, 1983

[51] Int. Cl.[3] ..... A63H 3/24

[52] U.S. Cl. ..... 446/304; 446/330

[58] Field of Search ..... 46/141, 115, 119; 401/152, 155, 161, 149, 188; 446/304, 268, 330, 331

[56] References Cited

U.S. PATENT DOCUMENTS

| | | | |
|---|---|---|---|
| 3,005,283 | 10/1961 | Cohn | 46/141 |
| 3,690,779 | 9/1972 | Ellis | 401/188 |
| 3,858,352 | 1/1975 | Cummings et al. | 46/141 |
| 4,413,441 | 11/1983 | Hunter et al. | 46/141 |

FOREIGN PATENT DOCUMENTS

| | | | |
|---|---|---|---|
| 570922 | 5/1932 | Fed. Rep. of Germany | 401/155 |
| 717419 | 10/1954 | United Kingdom | 401/155 |

*Primary Examiner*—Robert A. Hafer
*Assistant Examiner*—Daniel Nolan
*Attorney, Agent, or Firm*—Gene O. Enockson; L. MeRoy Lillehaugen; Stuart R. Peterson

[57] ABSTRACT

The doll illustrating the toy figure includes an ingestion system having an inlet opening and an outlet opening. A resilient or flexible tube connects the inlet opening to the outlet opening. The resilient tube includes a straight longitudinal section within the doll's body. A carriage unit is constrained for rectilinear movement relative to the straight section, a roller movable with said carriage unit performing a persistalic pumping action as it is progressively moved downwardly along the straight section of the tube. A manually actuated lever connected to the carriage unit permits a child to move the carriage unit downwardly, the lever projecting through a slot in the back of the doll's body. Provision is made for only partially collapsing the tube as the carriage unit is returned to its initial position by means of a roll spring. The head of the doll is made of deformable resilient material, a cam link unit coupled to the carriage unit acting on a jaw lever unit to close the doll's normally open mouth as the child moves the actuating lever downwardly.

22 Claims, 13 Drawing Figures

10
12
168
164
166
76
78
80
82
18
22
26
74
180
182
28
20
24
86
36
176
66
30
174
150
172
120
138
144
154
158
140
136
120
110
162
118
160
148
116
106
132
114
104
94
48
112
92
98
40
96
104a
110
30
64
52
58
56
54

12
9
76
74
78
80
26
82
164
170a
28
180
24
88
86
36
90
104
104b
40
94
170b
174
112
48
30
104a
172
154
156
146
148
110
112
150
160
120
132
144
118
114
106
186
9
152
58
56
54

TOY FIGURE WITH MANUALLY OPERABLE INGESTION SYSTEM

BACKGROUND OF THE INVENTION

1. Field of the Invention

This invention relates generally to toy figures in the form of a doll, animal or the like, and pertains more particularly to such a figure having a manually operable ingestion system for simulating the eating and disposing of a food-like material.

2. Description of the Prior Art

Indicative of the prior art known to us is the toy described in U.S. Pat. No. 3,858,352granted on Jan. 7, 1975 to Charles A. Cummings et al. for "Doll with Ingestion System". The Cummings et al patent is assigned to the same assignee as the present invention. The doll exemplified in said patent has performed admirably and has been widely accepted. Inasmuch as it is electrically operated, the cost of manufacturing such a toy, and its ultimate price to the customer, has been greater than some purchasers have been willing to pay. In spite of the higher than desired manufacturing cost, the realism of the patented toy has contributed tremendously to the widespread acceptance thereof.

Another toy embodying an ingestion system is described in French Patent No. 2,081,998, granted on Nov. 15, 1971. It also depicts a doll in which the pumping action is electrically derived.

SUMMARY OF THE INVENTION

Accordingly, an important object of the present invention is to provide a toy figure embodying an ingestion system therein which is manually operated in contradistinction to being electrically operated. Stated somewhat differently, an aim of our invention is to provide a non-electrical system which does not require the use of a motor, batteries and associated electrical circuitry.

Another object of the invention is to provide a doll or other toy animal that will be easy to operate, very little manual effort and dexterity being required inasmuch as the actuating mechanism makes use of a simple lever providing a considerable mechanical advantage with a concomitant minimal amount of force from the user. Owing to the extremely simple manner in which our toy figure operates, the invention will have considerable appeal to small children, as well as older children, inasmuch as the child participates to a greater degree than heretofore in effecting the passage of a food-like substance through the toy figure because the child physically moves a lever rather than merely closing a switch.

Another object of the invention is to provide a toy figure with an ingestion system that lends itself readily to being thoroughly cleaned, thereby inhibiting the growth of bacteria within the system where the moist environment resulting from a water-containing food-like material would tend to encourage bacterial growth in some cases. In this regard, an aim of the invention is to provide a pumping mechanism utilizing a resilient or flexible tube, the pumping mechanism when in its inactive state causing the bore of the tube to be automatically open so that water can be flushed readily therethrough to wash out the residual food.

Still another object is to provide a pumping mechanism that moves the food-like material in substantially only one direction, thus minimizng the opportunity for the food material to be forced or pumped backwardly through the mouth of the toy via which the food is initially introduced.

Yet another object is to provide a manually operable ingestion system for toy figures that will not only effectively advance the food-like material in the proper direction but which will simultaneously actute the mouth of the figure so as to create a life-like and realistic eating action. More specifically, when practicing the teachings of our invention the mouth is automatically opened and closed as the simulated food is being pumped.

Also, the invention has for an object the provision of an ingestion system functional irrespective of position in which the toy figure may be oriented. Thus, an aim of the invention is to avoid frustration that might otherwise occur where the child is unaware that a particular position should be first realized before actuating the pumping mechanism. Of course, it is intended that the toy figure, for the most part, assume a sitting position when being fed its simulated food.

Inasmuch as it is contemplated that out invention will be embodied in toy figures intended to be used by children of various ages, another object is to provide an actuating mechanism that will be inconspicuous when not in actual use. Stated somewhat differently, an aim of the invention is to provide a lever that can be pivoted into a recessed position at the back of the toy when not needed and pivoted into a projecting position when employed to pump food.

Still further, the invention has for an additional object the provision of a toy figure of the foregoing character that will be rugged, virtually indestructible and maintenance free.

Another object is to provide a toy figure incorporating therein a manually operable ingestion system, the bulk or mass of such system being capable of being located within the body or torso of the toy to optimize its center of gravity and to produce a better and more realistically balanced toy. More specifically, an aim of the invention is to avoid having any appreciable weight or mass in the toy's head, it being planned that the pumping mechanism be disposed within the body and that only the parts needed for actuating the mouth be housed within the head of the figure.

Briefly, our invention envisages the employment of a relatively rapid hollow body or torso having a slot in the back thereof. Within the body or torso is a flexible or resilient tube that extends from an inlet opening to an outlet opening, the inlet opening being directly associated with the mouth of the figure and the outlet opening being directly associated with the crotch of the figure. A peristaltic pumping action is realized by means of a carriage having a roller that is pressed against the flexible tube as the carriage is forced manually from a position nearer the head to a position nearer the figure's crotch. A constant force spring is utilized to return the carriage and its roller to their initial or inactive position, provision being made for causing the roller to only lightly bear or press against the flexible tube on the return stroke, whereas the roller exerts enough pressure to progressively collapse the tube during the pumping stroke.

The carriage moves in a rectilinear direction to produce a peristaltic pumping action, the actuating force being derived from the manual movement of a pivotal lever attached to the carriage. The outer end of the lever has laterally extending wings that are engaged by the user's fingers to cause movement of the carriage from a position nearer the head's inlet opening to a second position nearer the body's outlet opening. The wings can be swung into a recess formed on the back of the body or torso, thereby effecting a generally flush or smooth appearance when the lever is not in use. The flexibility or resiliency of the tube enables the tube to automatically flex back to its open condition when the carriage is returned to its initial or starting position. A cam link unit moves in concert with the carriage, the link unit having a cam thereon that rocks a jaw lever unit in a direction to close the figure's mouth. The head is fabricated from a deformable elastomeric material having sufficient resiliency so that the mouth remains open when not forced closed.

DESCRIPTION OF THE PREFERRED EMBODIMENT

Figure 1:
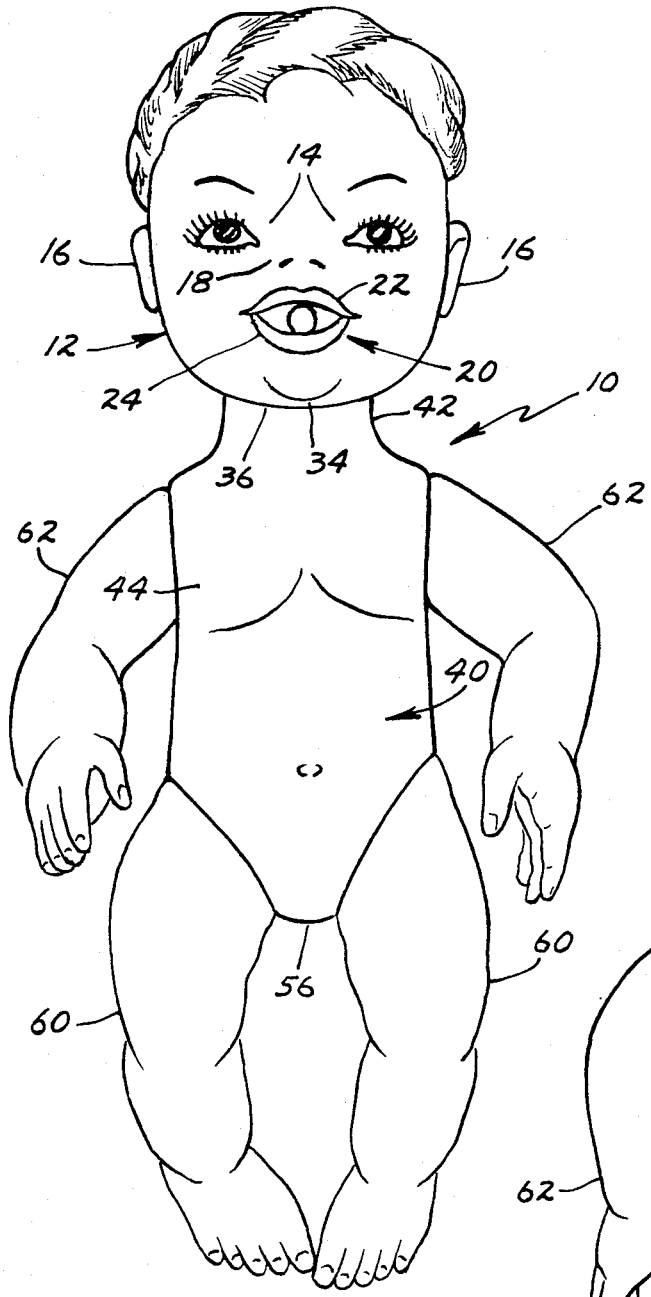
FIG. 1 is a front elevation view of a toy figure in the form of a doll exemplifying our invention.

The toy figure selected to illustrate our invention is in the form of a doll indicated generally by the reference numeral 10.

The doll 10 includes a hollow head 12 of an appropriate deformable elastomeric material, such as plasticized PVC. The head 12 is intended to be soft and pliable, yet having a degree of resiliency that is made use of for a purpose hereinafter referred to. Although not important to a practicing of the invention, the head 12 includes eyes 14 and ears 16. Although the head 12 includes a nose 18, it will later be appreciated that the nose 18, even though of elastomeric material, should be prevented from deforming. Also, the head 12 includes a mouth 20 having an upper lip 22 and a lower lip 24, there being a cavity 26 inwardly disposed with respect to the lips 22, 24. At the inner or rearward end of the cavity 26 is an inlet opening 28 via which a food-like material 30 in a semi-solid state passes into a tubular nipple 32, which can be similar to that mentioned in U.S. Pat. No. 3,858,352. Still further, the head 12 includes a chin or jaw 34. Located at the base of the head 12 is a circular opening 36.

At this time reference will be made to a hollow torso or body 40, the body 40 being quite rigid in contrast to the head 12. Suggestively, the torso or body 40 can be fabricated of ABS plastic. It will facilitate the ensuing description to consider the torso or body 40 as of one-piece construction; in practice, the torso or body 40 is constructed of two pieces. At the upper end of the body 40 is a cylindrical neck 42 which is engageable within the circular opening 36 formed in the base of the head 12. In other words, the head 12 is attached to the body 40 via the neck 42. It will be helpful to label the front and back of the body 40, the front being denoted by the reference numeral 44 and the back by the reference numeral 46. The back 46 is formed with a vertical slot 48 having a recess 50 at its upper end. The slot 48 extends downwardly from the recess 50 to a location adjacent the buttocks 52. It is to be noted that a discharge or outlet opening 54 is formed in the crotch labeled 56. Extending upwardly from the outlet opening 54 is a tubular fitting or nipple 58, the nipple 58 being anchored securely within the portion of the body 40 constituting the crotch 56.

Still further, the doll 10 includes a pair of legs 60 and a pair of arms 62, none of which limbs 60, 62 is important as far as out invention is concerned. As with the eyes 14 and ears 16, our intention is to show a construction representing a complete figure.

Extending downwardly from the inlet opening 28 to the outlet opening 54 is a deformable resilient and flexible plastic tube 64, such as PVC, which includes a straight longitudinal section 66 that is collapsible when subjected to sufficient pressure. More specifically, the upper end of the tube 64 is fitted over the nipple 32 and the lower end thereof is fitted over the nipple 58.

As indicated above, the torso or body 40 can be formed of more than one part. Likewise, the body is provided with various protuberances integral with the inner surface thereof, the protuberances cooperating in the anchoring of a housing unit 70 within the interior of the body 40. The housing unit 70, it can be pointed out, is of relatively rigid plastic, ABS plastic being satisfactory. The housing unit 70 includes an upper cylindrical end portion that projects upwardly into the head 12. Support means in the form of upstanding standards 74, which standards 74 are integral with the cylindrical end portion 72, have forwardly projecting portions 76 that form an elongated passage or bore 78 for the loose reception of the major portion of a rod 80 therein.

The purpose of the rod 80, which is relatively rigid, is to prevent the otherwise deformable nose 18 from flexing upwardly and inwardly. To resist any such flexing of the nose 18, the forward tip of the rod 80 is adhesively secured within a recessed plastic cup 82 which recessed cup 82 is in turn adhesively secured to the inside of the nose 18. As indicated above, the other end of the rod 80 is received in the passage or bore 78. It follows that the nose 18 simply reacts against the tip of the rod 80 adjacent thereto, and any tendency for the nose 18 to flex or deform inwardly is prevented because whatever reactive force is transmitted through the rod 80 to the closed end of the passage or bore 78.

A simulated eating action is imparted to the mouth 20 through the intermediary of a jaw lever unit 84 comprised of a pair of obtusely angled, laterally spaced side members 86, a cross bar 88 bridging one end which bar 88 is adhesively secured to the inner side of the chin 34 and a second cross bar 90 that functions as a cam follower. The rocking action imparted to the unit 84 will be more fully treated hereinafter. However, it is to be perceived, especially from FIGS. 3, 4 and 7, 8 that the jaw lever unit 84 is mounted in a free manner for rocking movement within the relatively large passage through which the previously mentioned resilient tube 64 extends, the tube 64 actually passing between the side members 86.

In addition to including the cylindrical end portion 72, the housing unit 70 includes at its other or lower end a channel-shaped end portion 92. The channel-shaped end portion 92 includes a web and laterally spaced side walls 96, each side wall 96 having an anchor notch 98 therein. It has already been explained that the body 40 includes various mounting elements which are molded thereinto; two of such elements extend into the notches 98 to assist in anchoring the housing unit 70 within the body 40.

Figure 12:
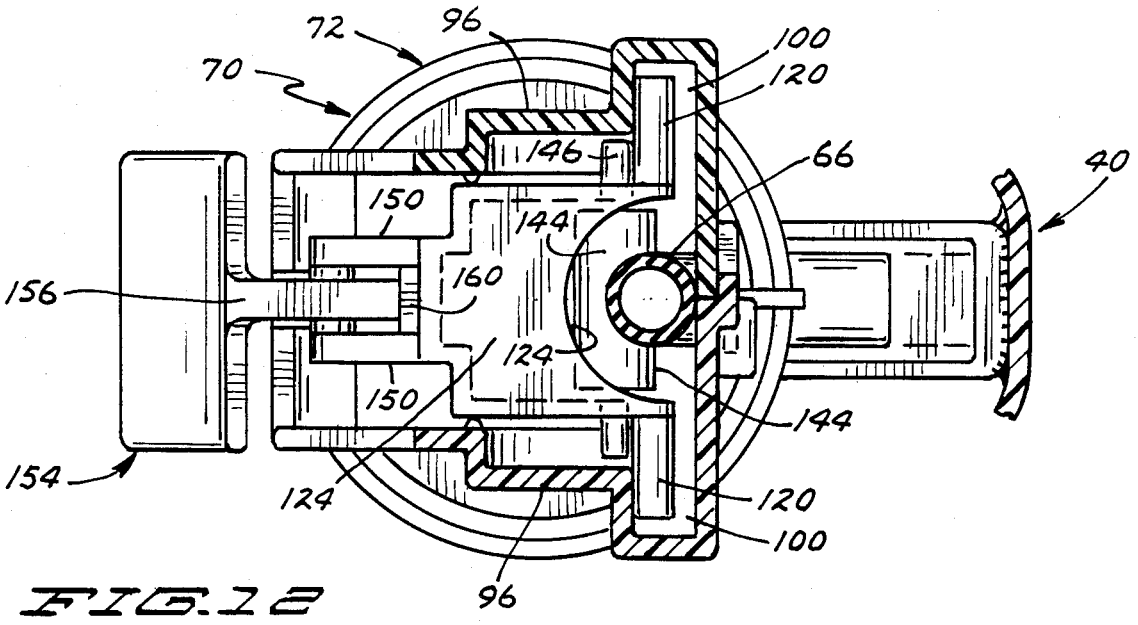
FIG. 12 is a transverse sectional view looking up in the direction of line 12—12 of FIG. 7.
Figure 13:
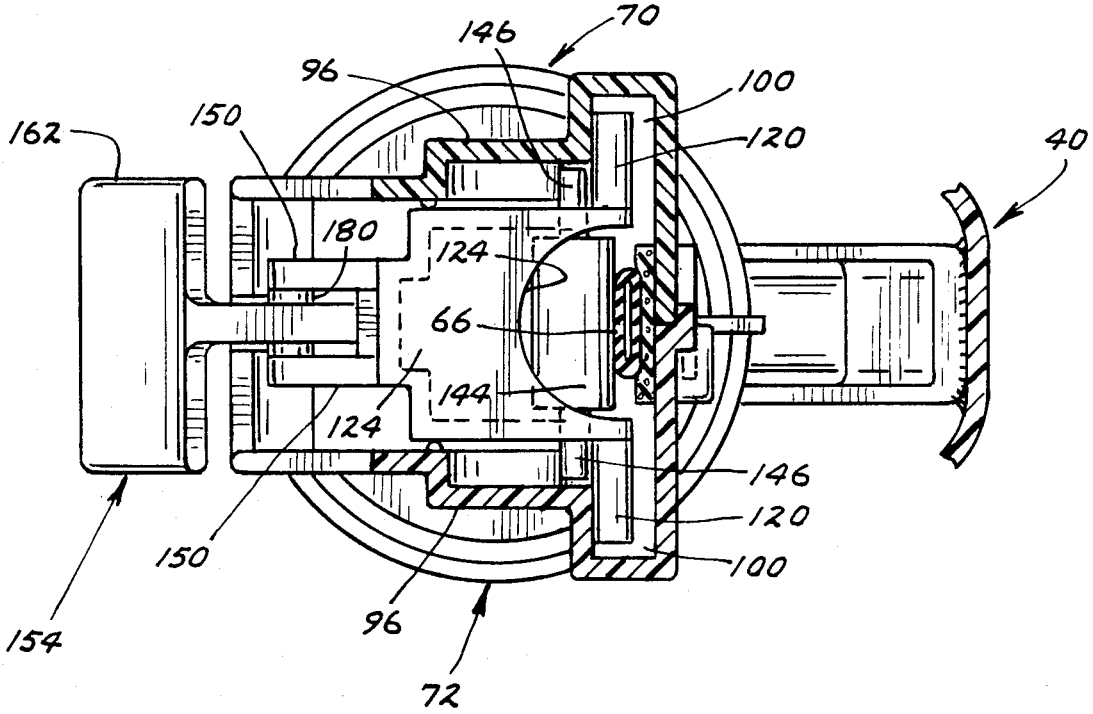
FIG. 13 is another transverse sectional view looking up, this view being taken in the direction of line 13—13 of FIG. 8.

As best understood from FIGS. 12 and 13, each side wall includes a tracking groove 100 for a purpose presently to be explained. Although not of major significance, the inner surfaces of the side walls 96 have formed thereon thin vertical ribs 102 that minimize friction as will become apparent shortly. More importantly, the side walls 96 are contoured so as to provide guide rails 104 forming, in each instance, a lower downwardly and rearwardly sloping cam edge 104*a* and an upper cam edge 104*b* sloping upwardly and rearwardly inclined cam edges.

It may be well at this stage to refer to a pressure pad or cushion 106 that confronts the rear side of the web 94 of the channel-shaped end portion 92, the pad or cushion having a pair of vertically spaced apertures 108 therein through which lugs or protuberances 110 integral with the straight section 66 of the resilient tube 64 extend, the web also having apertures 112 so that the tube 64 is releasably anchored to the web 94 with the pad or cushion 106 therebetween. It is planned that the pad or cushion 106 be adhered to the web 94.

Playing an important role in practicing our invention is a carriage unit indicated generally by the reference numeral 114. The carriage unit 114 is comprised of a casing 116, fabricated from a suitable plastic such as acetal, which casing 116 includes laterally spaced side walls 118 having a pair of outwardly issuing guide pins thereon which are adjacent the forward edge of each side wall 118; the pins 120, a total of four, extend into the previously mentioned tracking grooves 100 in the side walls 96 of the channel-shaped end portion 92 and in this way constrain the carriage unit 114 for rectilinear movement along the straight longitudinal section of the resilient or flexible tube 64.

The casing 116 also includes a top wall 122 and bottom wall 124, each of these last two walls 122, 124 having a curved edge 126 so as to enable the carriage unit 114 to travel along the resilient tube section 66 without the walls 122, 124 rubbing thereagainst. Still further, the casing 116 includes a rear wall 126 having a vertically oriented rectangular opening 128 therein, the lower edge of the opening 128 having an upwardly directed spring finger 130 for a purpose later described. It is also to be perceived that there is a horizontal stop rib 132, its function hereinafter being explained. The rear edge portion of the top wall 122 and the upper edge portion of the rear wall 126 are provided with notches that form what might be best described as an L-shaped slot 134 which serves an anchoring purpose which will be dealt with shortly.

In pursuance of the invention, the side walls 118 of the casing 116 are formed with notches 136. In this regard, it will be perceived from FIGS. 7 and 8 that each notch 136 has a shoulder or step 138 in its upper edge 140, the lower edge 142 not having such a step. More will be said presently regarding the function of the notches, 136, especially their shoulders or steps 138.

Contained within the cavity formed by the side walls 118, the top and bottom walls 122, 124, respectively, and the rear wall 126 is a roller 144 having oppositely directed shaft portions 146 integral with each end thereof. It is intended that the roller 144 be made of the same plastic as the casing 116, namely an appropriate acetal. The roller 144 and its shaft portions 146 resemble a kitchen-type rolling pin in shape, although minuscule in comparison. The roller 144 has an axial length dimensioned so that the roller is freely received between the side walls 118. However, the shaft portions 146 project from the ends of the roller 144 to an extent so as to not only be engageable with the edges 140, 142 of the notches 136 in the side walls 118 but to also project laterally so as to ride against the guide rails 104, more specifically their inclined cam edges 104*a*, 104*b*.

A pressure pad or cushion 148 is suitably adhered to the forward face of the casing's rear wall 126, the roller 144 being capable of bearing thereagainst when its shaft portions 146 are not obstructed by the shoulders or steps 138. The purpose of pad 148 is to eliminate nose of roller 146 when it disengages from the carriage after the pumping stroke.

The casing 116 also includes a clevis 150 integral with the rear wall 126, the clevis 150 projecting rearwardly from the rear wall 126 and having a pair of aligned openings or holes 152 therein.

It can be stated at this point that the carriage unit 114 is to be manually actuated in a downward vertical direction. It should be remembered that the laterally issuing pins 120 that are slidably received in the tracking grooves 100 formed in the side walls 96 of the channel-shaped end portion 92 of the housing unit 70 guide or constrain the carriage unit 114 for movement in a rectilinear path along the section 66 of the resilient tube 64.

Figure 3:
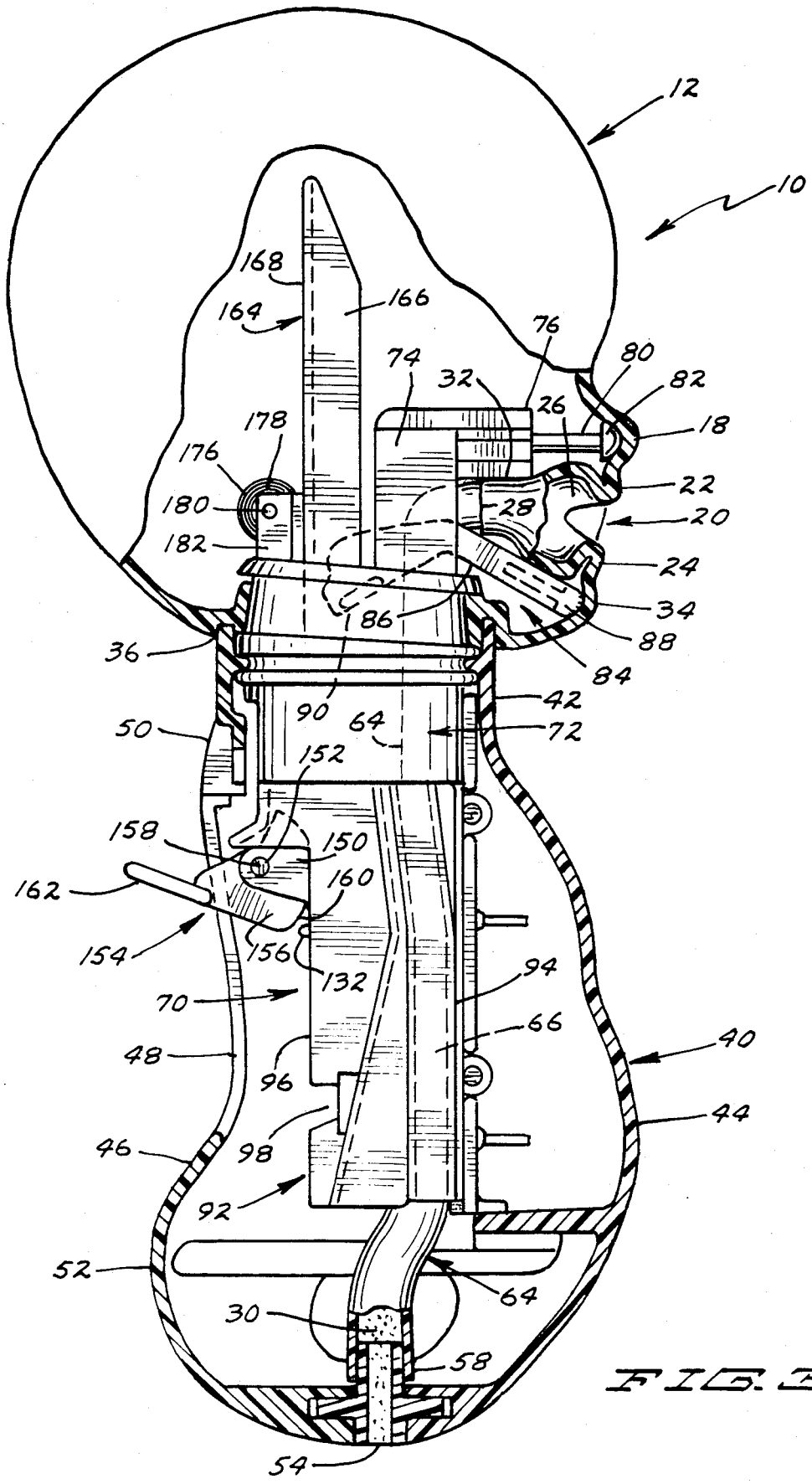
FIG. 3 is an enlarged side elevational view corresponding to FIG. 2, portions of the head and the body being removed in order to reveal parts that would otherwise be concealed, the actuating lever having been pivoted outwardly for manual operation of the ingestion system.
Figure 4:
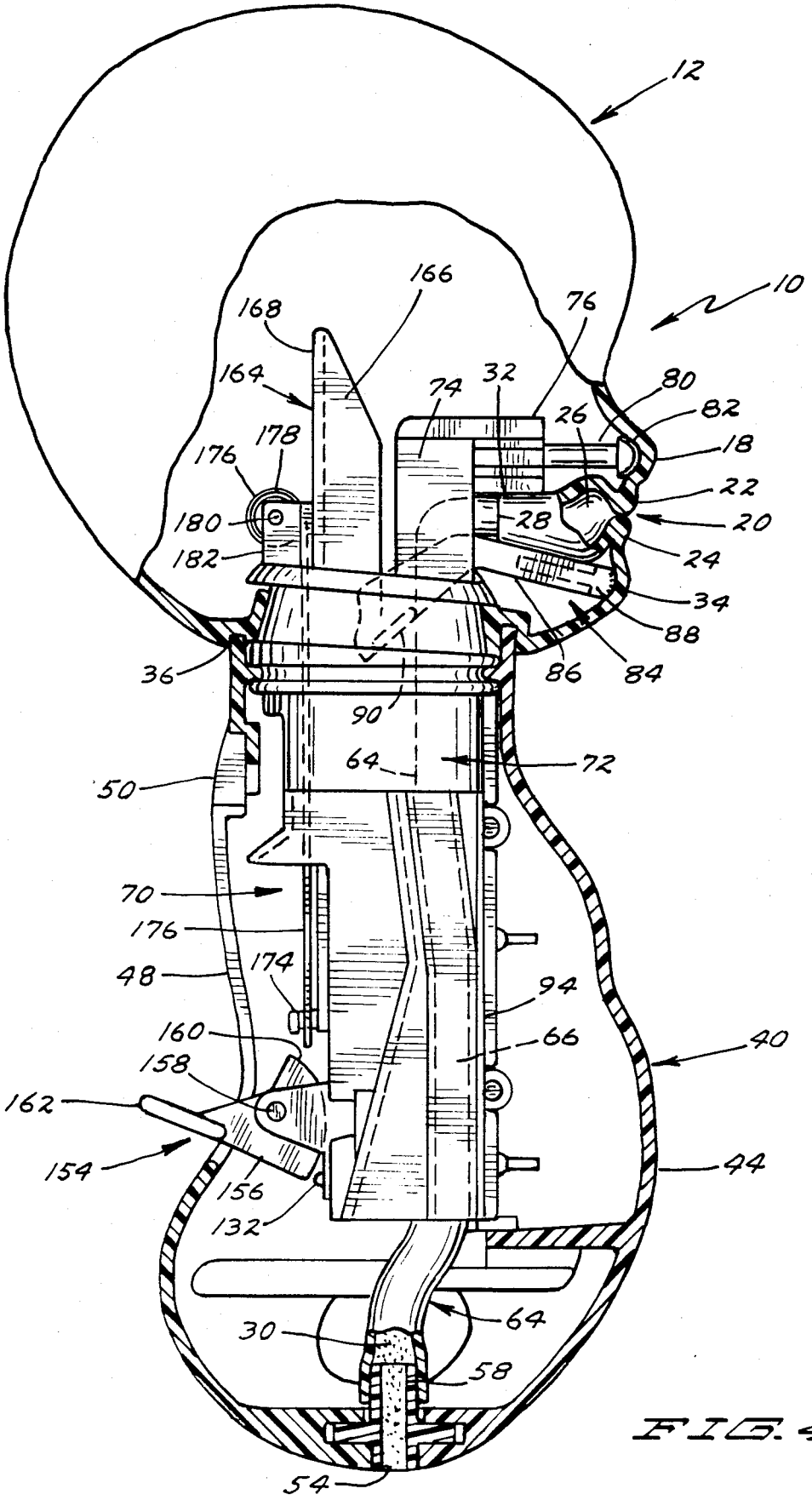
FIG. 4 is a view corresponding to FIG. 3 but with the actuating lever having been manually moved downwardly to effect a peristaltic pumping of a food-like substance in a downward direction.
Figure 5:
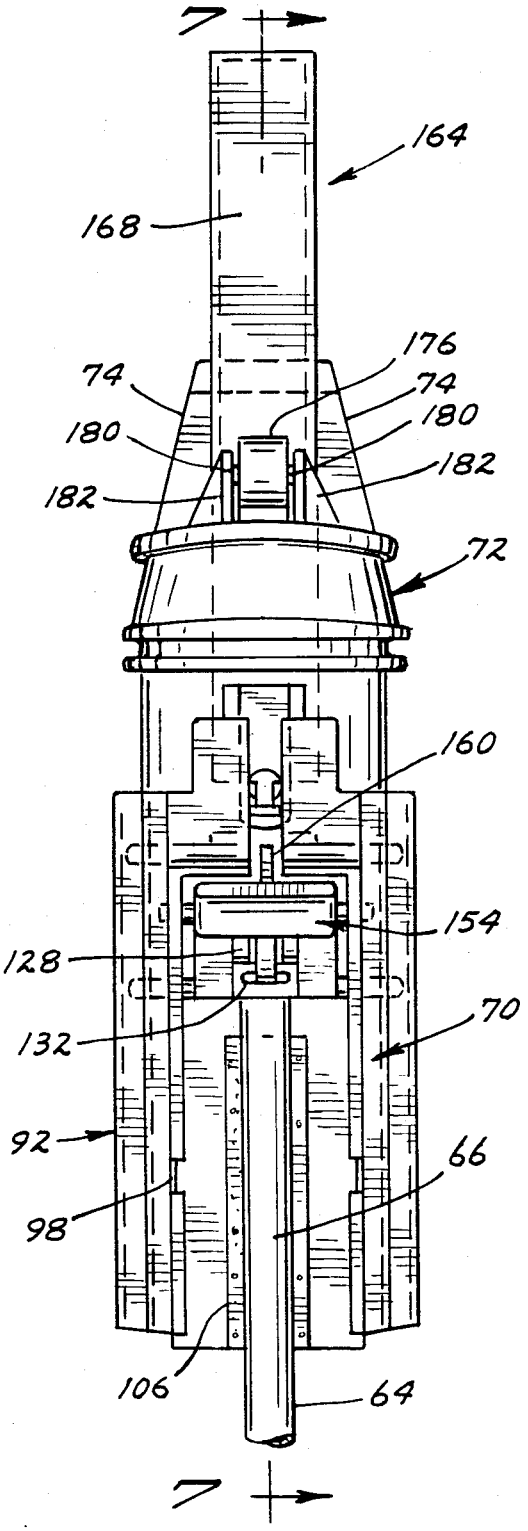
FIG. 5 is a rear elevational view of certain parts contained within the head and body, the position of the parts corresponding to the position thereof in FIG. 3.
Figure 6:
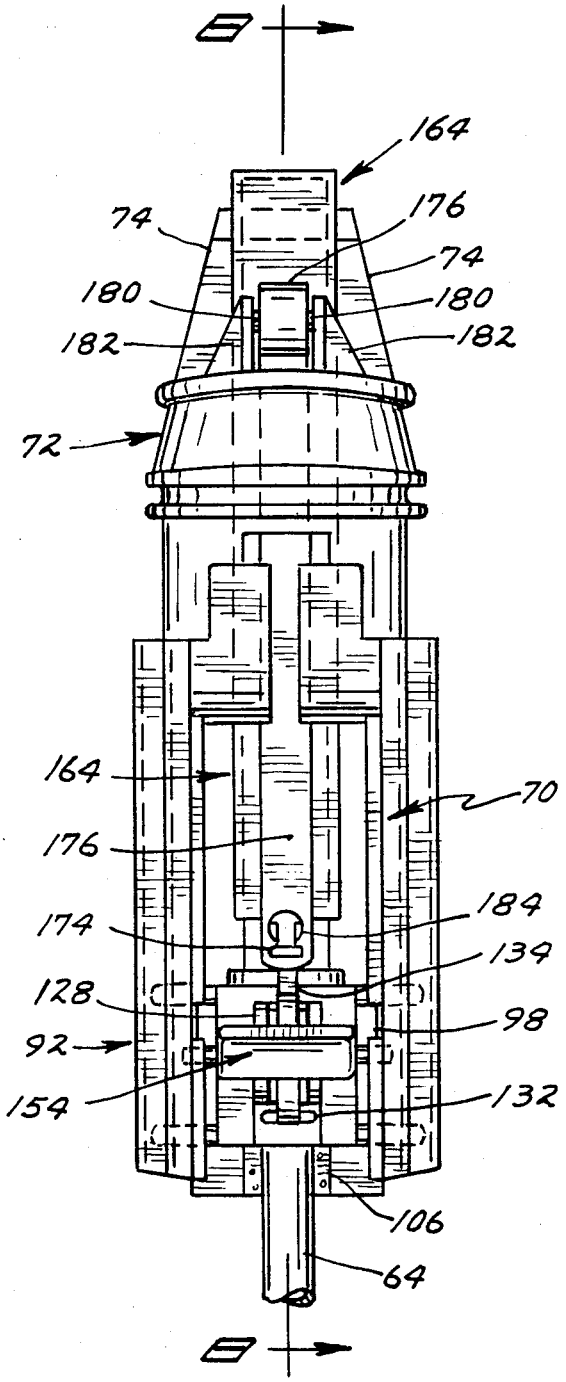
FIG. 6 is a rear elevational view taken in the same direction as in FIG. 5, but with the position of the parts corresponding to the position thereof shown in FIG. 4.

The manner in which the carriage unit 114 is manually moved downwardly is through the agency of an actuating lever 154 having a shank 156 with integral pins 158 projecting from the opposite sides thereof, the pins 158 being received in the clevis holes 152 referred to just above. The shank 156 is formed with an eccentric edge 160 that bears against the spring finger 130 extending upwardly from the lower edge of the rectangular opening 128 formed in the rear wall 126 of the casing 116. The edge 160 of the eccentric is contoured so as to provide an over-center action with respect to the spring finger 130 which enables the operating or actuating lever 154 to be retained in either of two pivotal positions, either the raised position shown in FIG. 2 or the outwardly projecting position such as shown in FIGS. 3 and 4, as well as FIGS. 7 and 8. It is also to be observed that the lever 154, more specifically the outer end of its shank 156 (this being the end remote from the pins 158) is equipped with a pair of laterally issuing wings 162.

The laterally issuing wings 162 on the lever 154 permit a person's fingers to press against the upper sides thereof so that the carriage unit 114 can be readily actuated downwardly. It has already been explained that the carriage unit 114 is constrained for rectilinear movement relative to the straight longitudinal section 66 of the resilient tube 64. It is through the agency of the operating lever 154 that the manual force required to move the carriage unit 114 downwardly is realized.

Coacting with the jaw lever unit 84 is what will be termed a cam link unit 164. Basically, the cam link unit 164 is channel shaped, being comprised of laterally spaced side walls 166 and a connecting web 168. The forward side of the connecting web 168 has a pair of centrally located but laterally spaced cam strips 170, each strip having an upper vertical edge **170*a* and a lower downwardly and rearwardly sloping edge 170*b*. The edges 170*a*, 170*b*, it can be pointed out, bear against the cross bar 90 of the jaw lever unit 84. Extending downwardly from the lower end of the cam link unit 164 is a T-bar 172 that engages in the L-shaped slot 134 provided in the casing 116 of the carriage unit 114. Projecting rearwardly from the upper end of the T-bar 172 is a T-shaped key 174**.

Whereas the operating or actuating lever 154 enables the carriage unit 114 to be manually actuated downwardly, a constant force extension or roll spring 176 automatically elevates or retracts the cam link unit 164 and the carriage unit 114, the latter unit 114 by virtue of the connection of the T-bar 172 with the L-shaped slot 134 at the upper end of the casing 116 of the carriage unit 114. The constant force extension or roll spring 176 is carried on a spool 178 rotatively mounted on pins 180 extending inwardly from upstanding standards or support elements 182 on the upper end of the cylindrical end portion 72 of the housing unit 70. It is believed evident from the description given with respect to the housing unit 70 that this unit 70 is held in an immobile manner within the body 40 of the doll 10. Hence, the spool 178 only rotates to permit the lower end of the spring 176 to be pulled downwardly when the lever 154 is actuated downwardly by a child's hand. The spring 176, resembling a ribbon, has a keyhole slot 184 formed therein which receives the projecting end of the T-shaped key 174. In that the carriage unit 114 is coupled to the cam link unit 164 by means of the T-bar 172, it follows that when the constant force or roll spring 176 is permitted to retract (which it does when a manual force is no longer applied to the wings 162 on the lever 154), the two tandemly-connected units 114 and 164 are pulled upwardly in unison.

Figures 7, 8:
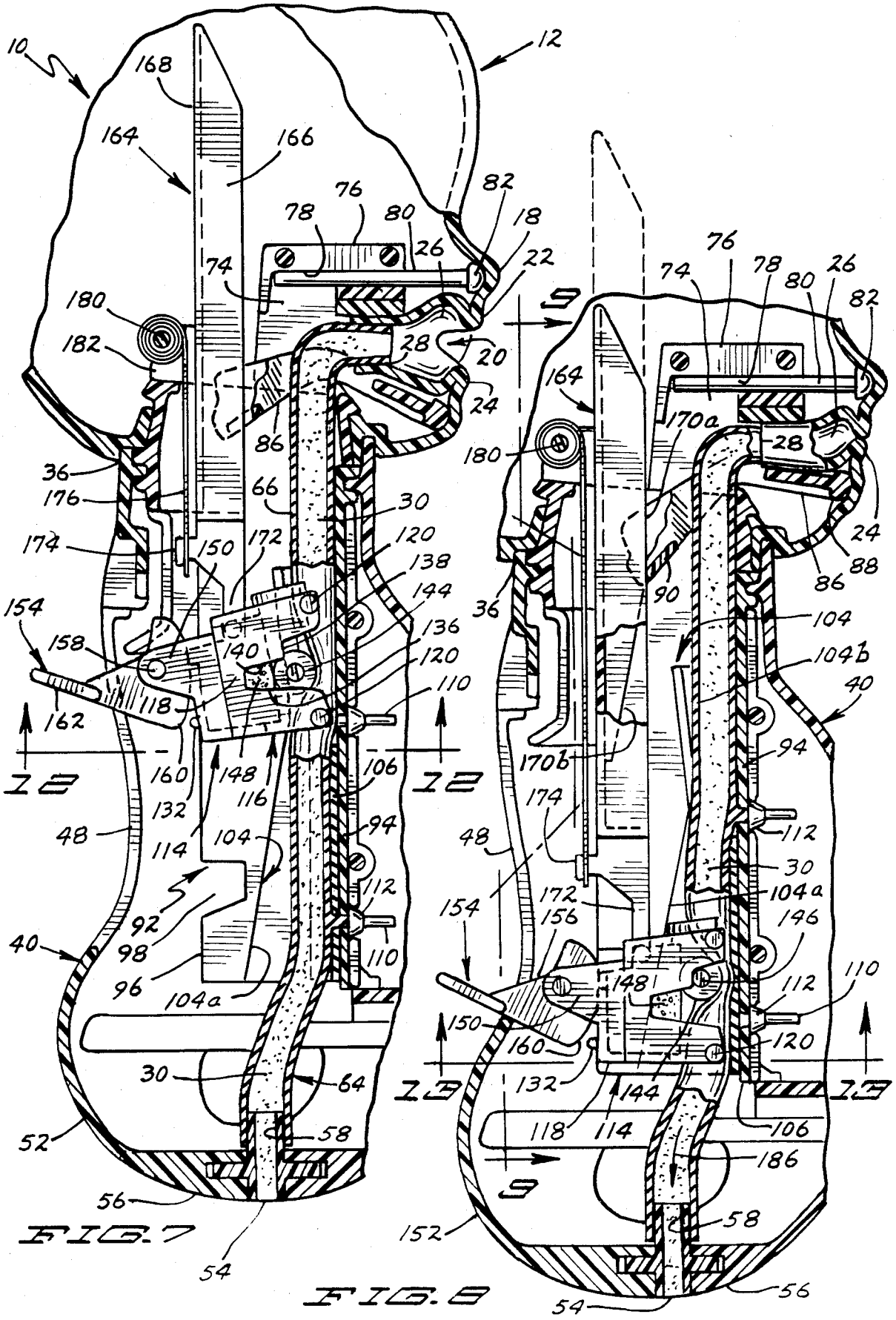
FIG. 7 is a sectional view taken generally in the direction of line 7—7 of FIG. 5 but including the doll's head and body.
FIG. 8 is a sectional view taken generally in the direction of line 8—8 of FIG. 6 but also including the doll's head and body.
Figure 9:
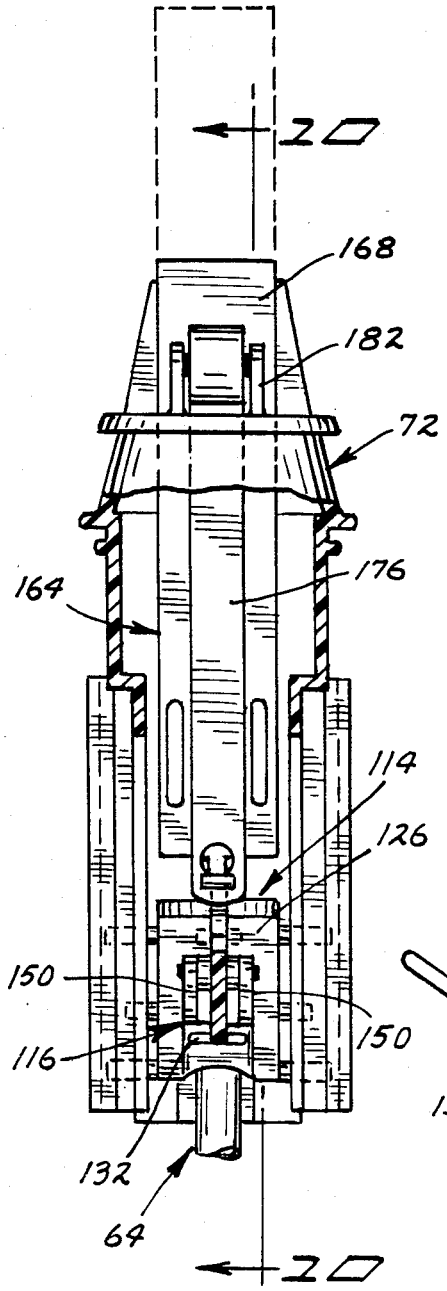
FIG. 9 is a sectional view taken generally in the direction of line 9—9 of FIG. 8.
Figure 10:
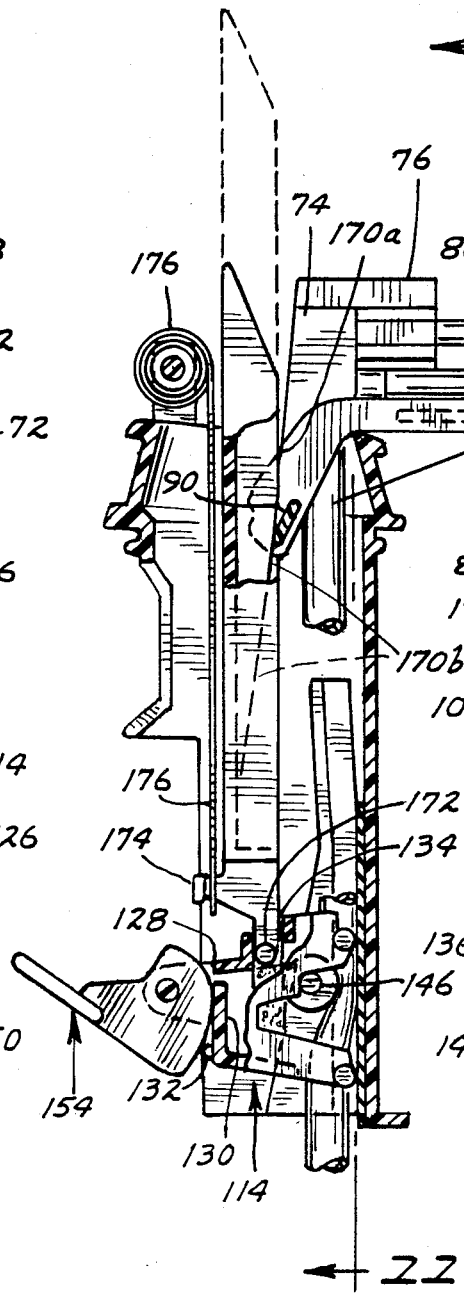
FIG. 10 is a sectional view taken in the general direction of line 10—10 of FIG. 9.
Figure 11:
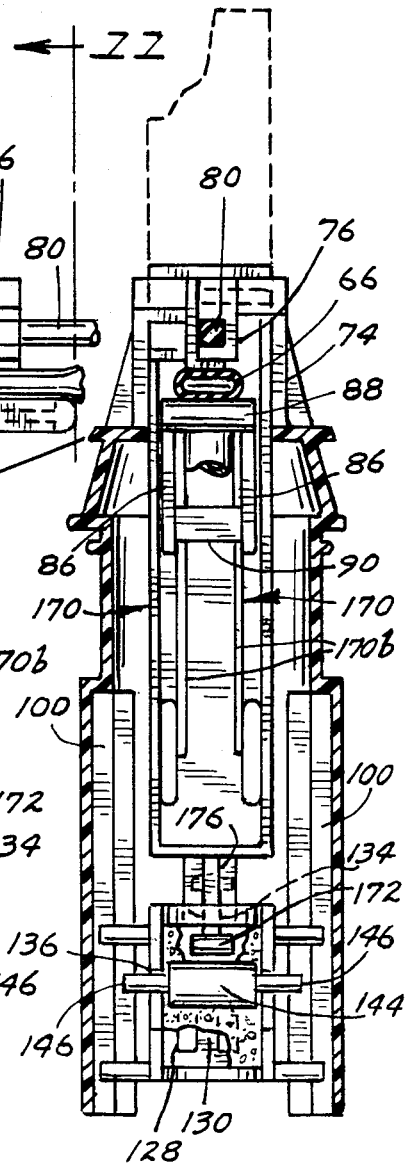
FIG. 11 is a sectional view taken in the general direction of line 11—11 of FIG. 10.

Inasmuch as it is intended that the doll 10 "consume" a semi-solid or biscus material resembling real live baby food, such material has been identified earlier herein by the reference numeral 30. In FIG. 8, the substance or material 30 is being pumped downwardly in the direction of the arrow 186, as will be understood when considering the ensuing operational sequence.

OPERATION

Figure 2:
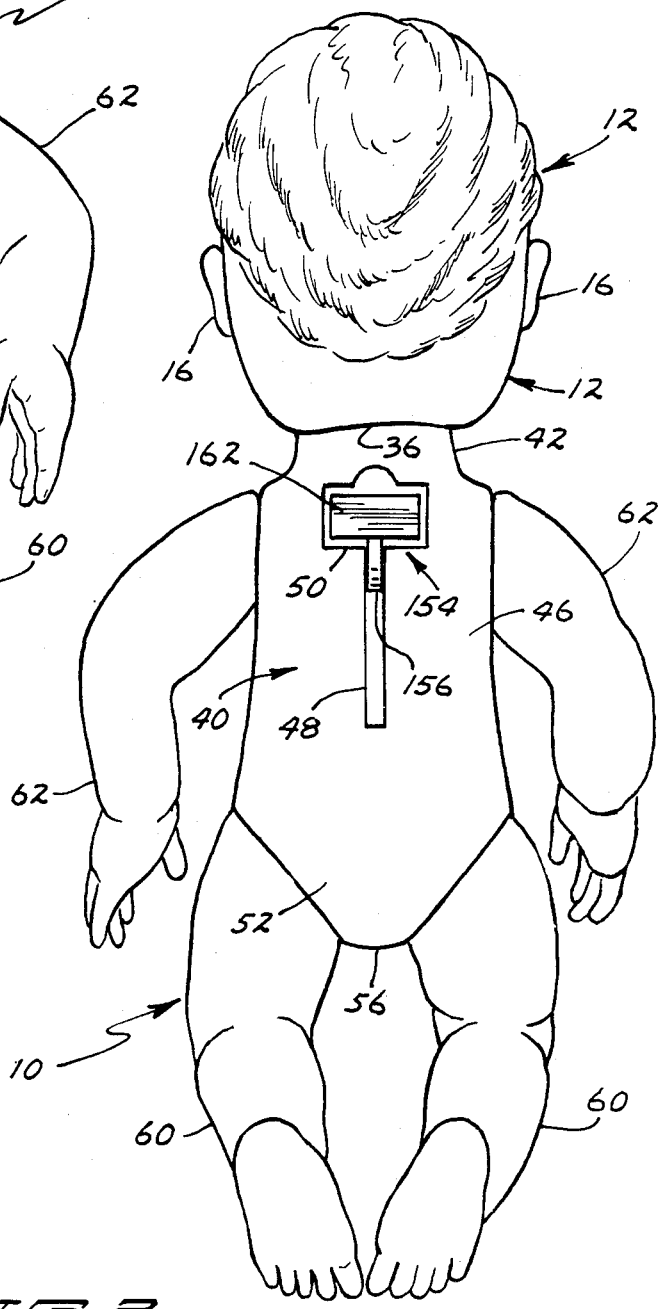
FIG. 2 is a rear elevational view of the doll, the actuating lever having been pivoted upwardly into a recessed or non-use position.

With the actuating lever 154 stowed in the position depicted in FIG. 2, it will be appreciated that the doll 10 is handled and played with just as any ordinary doll is handled and played with. However, when the doll 10 is to be fed, the child will extract the lever 154 from its recessed position, as shown in FIG. 2, merely pivoting the lever 154 downwardly by means of the laterally issuing wings 162 thereon; this position appears in FIGS. 3 and 7 and constituting an initial operating position of the lever 154 prior to inaugurating the feeding step. At this time, the child can spoon feed the simulated food 30 into the doll's mouth 20 or can resort to a bottle that contains the imitation food 30. The mouth 20 at this time is open.

Once the food has been introduced into the doll's mouth 20, the child then manually actuates the lever 154, pressing his or her fingers against the upper sides of the wings 162, so as to move the lever 154 downwardly. The eccentric edge 160 on the shank 156 of the lever 154 is contoured so that the lever 154 transmits the manual force being exerted by the child to the carriage unit 114, the eccentric edge 160 bearing against the stop rib 132 on the rear wall 126 of the casing 116 belonging to the carriage unit 114.

Before the lever 154 is moved downwardly by the child to start the downward movement of the food-like material, the vertical cam edges **170*a* on the centrally disposed cam strips 170 are initially at an elevation above the cross bar 90 belonging to the jaw lever unit 84. Owing to the inherent resiliency of the elastomeric material of which the head 12 is formed, such resiliency has caused the jaw lever unit 84 to be rocked in a clockwise direction so that the mouth 20 assumes the open condition appearing in FIG. 3. In other words, the lips 22, 24 are separated and it is when this condition exists that the child introduces food between the lips 22, 24 into the cavity 26 having the inlet opening at its inner end. Stated somewhat differently, the angulation of the cam edges 170*b* or the cam strips 170 of the cam link unit 164, which decline downwardly and rearwardly, provide no camming action when the cam link unit 164 is fully raised, as it is when the lever 154 is not being manually depressed, for the roll spring 176 under these conditions has pulled the carriage unit 114 and the cam link unit 114** upwardly.

However, when the child exerts a downward force on the lever 154, the lever 154 begins to move downwardly within the vertical slot 48. This action causes the cam link unit 164 to be pulled down along with the carriage unit 114 to which the lever 154 is pivotally attached. It is during this downward movement that the angled cam edges **170*b* bear against the cross bar 90 so as to rock the jaw lever unit 84 in a counterclockwise direction. Comparison of FIGS. 3 and 4 will show that the jaw lever unit 84 has been angularly moved in a counterclockwise direction in reaching the condition in which it appears in FIG. 4. Inasmuch as the cross bar 88 at the end opposite the end having the cross bar 90 being acted on by the cam strips 170 is adhesively connected to the inside of the chin 34 subjacent the lower lip 24, the lower lip 24 is moved upwardly to close the doll's mouth 20. The rod 80, which bears against the inner side of the doll's nose 18, resists any tendency for the nose 18 to be flexed inwardly and upwardly. Thus, the lower lip 24 is merely moved into engagement with the upper lip 22 inasmuch as the upper lip 22 is prevented from moving by virtue of the rod 80. Of course, the cam link unit 164 is only following the rectilinear downward movement of the carriage unit 114, being coupled thereto by means of the T-bar 172**.

The action supplied by the carriage unit 114 will now be described. Initially, since the roll spring 176 has retracted the carriage unit 114 upwardly, the carriage unit 114 assumes the rocked condition appearing in FIG. 7, this resulting from the fact that the upper cam edges 104*b* of the guide rails 104 on the side walls 96 of the lower channel-shaped portion 92 of the housing unit 70 incline rearwardly. Such a rocking action assures that the shaft portions 146, when the lever 154 is forced downwardly, roll along the upper edges 138 of the notches 136, compelled to do so by the camming action provided by the downward and forward angulation of the edges 104*b*, and are thus urged past the step 138 in a direction toward the longitudinal section 66 of the resilient of flexible tube 64.

Further manual movement of the lever 154 downwardly drags the carriage unit 114 therewith. This causes the shaft portions 146 to be forced, owing to the action of the edges 104*b*, in a direction to cause the roller 144 to bear with sufficient pressure against the tube 64 so as to compress the section 66, producing a peristaltic pumping action. Once again, owing to the angulation of the cam edges 104*b*, it follows that the shaft portions 146 are quickly forced in the direction of the flexible tube 64, causing the roller 144 to bear forcefully against the tube 64 and to thereby collapse the tube section 66 to the degree shown in FIG. 8.

In other words, as soon as the carriage unit 114 moves downwardly, the cam action applied to the roller 144 via the shaft portions 146 will shift the roller 144 to the right as viewed in FIG. 7 with the consequence that the tube 64 is squeezed almost immediately to the degree that it is shown in FIG. 13, FIG. 13 representing the completion of the progressive peristaltic pumping action.

A feature to be taken into account is that the tube 64, when the carriage unit 114 is uppermost, is not pinched completely closed. This enables the tube 64 to be flushed or cleansed with water if the doll 10 is not to be used for a period of time. The invention could cause the tube to open even further when the carriage is raised or uppermost, but this is not necessary. What is important is that the tube 64 not be collapsed or closed as completely as it is during the progressive downward movement of the roller 144, the downward movement of the roller 144 creating the pumping action in that the material 30 is forced downwardly beneath the roller 144. A region of reduced pressure or vacuum is created above the roller 144 so as to draw downwardly whatever food material 30 is thereabove.

It is important to appreciate that the shaft portions 146 are shifted within the notches 136 formed in the side walls 118 so as to bear against the steps 138 which steps 138 obstruct any reverse movement of the shaft portions 146 in a direction away from the tube 64 of these side walls 118. The shaft portions 146 remain captive with the steps after the carriage unit 114 has moved sufficiently downwardly into the region occupied by the downwardly and outwardly declining cam edges 104*b*, the edges 104*b* being ineffectual during the downward travel of the carriage unit 114. It is essential that this be appreciated, for it is the continued engagement of the shaft portions 146 with the steps 138 that produces the progressive peristaltic pumping action, for the roller 144 continues to be held against the tube 64.

On the other hand, when the carriage unit 114 is moved upwardly, as it will under the influence of the roll spring 176 when the wings 162 of the lever 154 are no longer being pressed by the child's fingers, the upward movement of the carriage unit 114 immediately releases the shaft portions 146 so that these portions 146 are free to move toward the closed ends of the notches 136. There is a drag imposed on the roller 146 by virtue of the collapsed condition of the flexible tube 64, as can be understood from FIG. 8, which assists in the disengagement of the shaft portions 146 from the steps 138.

Consequently, as the carriage unit 114 starts to move upwardly, the resiliency of the elastomeric material constituting the flexible tube 64 acts against the roller 144 to cause the roller 144 to move toward the closed ends of the notches 136, as just explained. As a result of this, it is the lower edges of the notches 142 that now act against the shaft portions 146 when the carriage unit 114 moves upwardly on its return stroke, the roller 144 now bearing against the tube 64 with a lesser degree of compressive force so that the tube section 66 is not flexed closed or collapsed as fully as happens on the downward stroke. This is highly desirable because the lesser collapsing force does not force the food-like material 30 upwardly, which upward movement of the food material 30 would create a regurgitating effect since the material, under such an assumed occurrence, would be discharged through the inlet opening 28, through the cavity 26 and outwardly through the mouth 20 itself if enough material 30 were reversely pumped.

Recapitulating, as the carriage unit 114 moves downwardly, the shaft portions 146 are constrained by the steps 138 so that they do not move in a direction away from the flexible tube 64. In this way, the compressive force exterted by the roller 144 continues to collapse the tube section 66, actually pressing the tube section 66 tightly against the pad or cushion 106 is producing the peristaltic pumping action. It is the continued and progressive collapsing of the tube 64 that produces a partial vacuum in the portion 66 of the tube 64 above the roller 144. The tube 64 is thus restored to its normally cylindrical condition above the roller 144 as is believed readily understandable from FIG. 8. Because the upper end of the tube 64 is connected to the nipple 32, and is thus in communication with the cavity 26 associated with the mouth 20, it follows that any food-type material 30 will be drawn into the tube 64 via the inlet opening 28. Concomitantly, any viscus material 30 in the tube 64 below the roller 144 will be forced down through the lower end portion of the tube 64 ahead of the roller 144 and will be excreted through the outlet opening 54, as should be readily understandable from FIG. 8.

Although other stop means could be used, it can be seen that when the operating lever 154 reaches the lower end of the stop slot 48, it can move no farther. Since the lever 154 is pivotally connected to the carriage unit 114, the carriage unit 114 itself is stopped prior to the lowermost pins 120 leaving the tracking grooves 100 formed in the side walls 96 of the housing's lower end portion 92.

It is when the downward force is no longer applied by the child on the wings 162 of the lever 154 that the spring 176 pulls the carriage unit 114 in an upward direction. It is during this upward travel of the carriage unit 114 that the roller 144 will rotate in a clockwise direction, as viewed in either FIGS. 7 or 8, literally rolling off the steps 138, the shaft portions 146 then being free to shift farther toward the closed ends of the notches 136, the roller 144 being integral with the shaft portions 146 and therefore moving in the same direction as the shaft portions 146. Once again, this action is quite important to a practicing of the invention inasmuch as the tube 64 is not completely collapsed during the upward travel of the carriage unit 114, thereby obviating the chance of any material inside the tube 64 being forced back up the tube 64 and out through the doll's mouth 20. This would constitute a regurgitating action, as already alluded to.

It will be appreciated that as the carriage unit 114 begins its upward travel from the position in which it is shown in FIG. 8, the shaft portions 146, even though disengaged from the steps 138 and forced toward the rear of the doll 10 by reason of the elasticity inherent in the elastomeric material of which the tube 64 is fabricated, the guide rails 104, more specifically the lower cam edges 104*a* thereof, act on the shaft portions 146 to cause a partial collapsing of the tube 64, but not to any significant degree. The sought after result is not to recollapse the tube to the degree that it is completely closed.

The roller 144, when the carriage unit 114 is at the top of its upward or return stroke, is conditioned or readied for the next cycle to begin. When the next cycle does begin, the rocking action of the carriage unit back into the position appearing in FIG. 7 will repeat the collapsing action that is continued during the entire downward stroke or travel of the carriage unit 114. As previously stated, however, it is desirable to maintain the tube 64 partially open so that it can be cleansed of whatever food material 30 remains in the tube 64, and the arrangement that has been described achieves this.

It should be recognized that the mouth 20 is normally open, as can be seen in FIG. 7, but when the pumping action takes place, as it does when the lever 154 is forced manually downwardly, the mouth 20 is closed, as can be understood from FIG. 8. Consequently, during the downward travel of the carriage unit 114, not only is the desired pumping and flow of the food substance 30 achieved but mouth 20 is closed owing to the camming action performed by the cam link unit 164, more precisely by the action of the cam strips 170, particularly their edges 170*b*. When the cam link unit 164 returns to its upper position, which it does by virtue of the pulling action exerted by the roll spring 176, the mouth 20 is again allowed to open in that the edges 170*a* again act on the cross bar 90 of the jaw lever unit 84 with the consequence that the cross bar 88, being fixedly attached to the inside of the lower lip 24, moves the lower lip 24 upwardly toward the upper lip 22. By reason of the rod 80, which prevents the nose 18 from flexing inwardly, a stiff upper lip 22 is maintained, the upper lip being in close proximity to the nose 18 thereabove.

We claim:

1. A toy figure comprising a body member having an outlet opening, a head attached to said body member having a mouth and an inlet associated with said mouth, tubular means connecting said inlet opening to said outlet opening, said tubular means including a generally straight longitudinal section of flexible tubular material, means constrained for movement in a rectilinear path along said longitudinal section in contact with said longitudinal section for compressing said longitudinal section as said compressing means is moved in a first direction away from said inlet opening toward said outlet opening to create a peristaltic effect within said tubular means, and manually-operable means for advancing said compressing means along said rectilinear path.

2. A toy figure in accordance with claim 1 in which said body member has a vertical slot in its back, said manually-operable means including a finger-engageable member projecting outwardly through said slot.

3. A toy figure in accordance with claim 2 in which said finger-engageable member is pivotally attached at one end to said compressing means and is provided with laterally-extending wings at its other end.

4. A toy figure comprising a body member having an outlet opening and a vertical slot in its back, a head attached to said body member having a mouth and an inlet associated with said mouth, tubular means connecting said inlet opening to said outlet opening, said tubular means including a generally straight longitudinal section of flexible tubular material, means constrained for movement in a rectilinear path along said longitudinal section for compressing said longitudinal section as said compressing means is moved in a first direction away from said inlet opening toward said outlet opening to create a peristaltic effect within said tubular means, and manually-operable means including a finger-engageable member projecting outwardly through said slot for advancing said compressing means along said rectilinear path, said finger-engageable member being pivotally attached at one end to said compressing means and being provided with laterally-extending wings at its other end, said body member having a recess at the end of said slot nearer said head for accommodating said wings therein.

5. A toy figure in accordance with claim 1 in which said compressing means includes a carriage and a roller journaled for rotation on said carriage, and means for causing said roller to engage said longitudinal section with a sufficient degree of pressure to collapse said longitudinal section as said carriage is moved in said first direction.

6. A toy figure comprising a body member having an outlet opening, a head attached to said body member having a mouth and an inlet associated with said mouth, tubular means connecting said inlet opening to said outlet opening, said tubular means including a generally straight longitudinal section of flexible tubular material, means constrained for movement in a rectilinear path along said longitudinal section for compressing said longitudinal section as said compressing means is moved in a first direction away from said inlet opening toward said outlet opening to create a peristaltic effect within said tubular means, said compressing means including a carriage, a roller journaled for rotation on said carriage and means for causing said roller to compressingly engage said longitudinal section with a sufficient degree of pressure to collapse said longitudinal section as said carriage is moved in said first direction, said means for causing said roller to engage said longitudinal section permitting said roller to engage said longitudinal section with a lesser degree of pressure as said carriage is moved in a second direction opposite to said first direction so that said roller does not fully collapse said longitudinal section when said carriage moves in said second direction, and manually-operable means for advancing said compressing means along said rectilinear path.

7. A toy figure in accordance with claim 6 including spring means for causing said carriage to be moved in said second direction.

8. A toy figure in accordance with claim 7 in which said spring means includes a roll spring.

9. A toy figure in accordance with claim 6 including shaft portions projecting laterally from the ends of said roller, said carriage having a notch at each side into which said shaft portions project, said notches having steps acting on said shaft portions to press said roller more firmly against said longitudinal section when said carriage is moved in said first direction, said steps being on the edges of said notches nearer said head so that said shaft portions become disengaged from said steps to allow said shaft portions and the roller to shift away from said longitudinal section when said carriage is moved in said second direction.

10. A toy figure in accordance with claim 9 including fixed cam means laterally outward of said carriage acting on said shaft portions to return said shaft portions into engagement with said steps when said carriage is moved in said second direction.

11. A toy figure in accordance with claim 10 including channel-shaped housing means within said body member for constraining said carriage for movement in said rectilinear path, said fixed cam means integral with said housing means.

12. A toy figure in accordance with claim 11 in which said fixed cam means constitutes a pair of angled guide rails along which said shaft portions ride as said carriage is moved in said second direction.

13. A toy figure in accordance with claim 12 including mouth actuating means, and means connecting said mouth actuating means to said compressing means.

14. A toy figure in accordance with claim 13 in which said mouth actuating means includes a jaw lever unit and a cam link unit, said cam link unit causing said jaw lever unit to close said mouth when said compressing means is moved in said first direction.

15. A toy figure in accordance with claim 14 in which said head includes at least a portion of elastomeric material forming said mouth, said elastomeric material possessing sufficient inherent resiliency to close said mouth when said compressing means and the cam link unit connected thereto are moved in a second direction opposite to said first direction.

16. A toy figure in accordance with claim 15 in which said mouth includes a deformable lip, one end of said jaw lever unit being secured to the inner side of said lip and the other end thereof being acted on by said cam link unit.

17. A toy figure in accordance with claim 16 in which said jaw lever unit is rockably disposed in said head, said cam link unit including a strip having a straight edge and an angled edge, said straight edge acting on the other end of said jaw lever unit to rock said jaw lever unit in a direction to overcome the resiliency of said elastomeric material to move said lip in a direction to close said mouth.

18. A toy figure in accordance with claim 17 in which said mouth includes a second deformable lip, and means within said head for resisting deformation of said second lip.

19. A toy figure comprising a body member, a head attached to said body member, said head including deformable elastomeric material forming first and second lips simulating a mouth, means forming an inlet opening in communication with said mouth, means forming an outlet opening associated with said body member, a flexible tube extending between said openings, said tube including a generally straight section contained within said body member, compressing means constrained for movement in a reciprocal path along said straight section, said compressing means including a roller, means for forcing said roller to move in one direction against, and in direct engagement with, said straight section to collapse said straight section when said compressing means is moved from a first position nearer said inlet opening to a second position nearer said outlet opening, means for manually moving said compressing means from said first position to said second position, and means actuated by said compressing means for relatively moving said lips in a direction to close said mouth when said compressing means is moved from its said first position toward its said second position.

20. A toy figure comprising a body member, a head attached to said body member, said head including deformable elastomeric material forming first and second lips simulating a mouth, means forming an inlet opening in communication with said mouth, means forming an outlet opening associated with said body member, a flexible tube extending between said openings, said tube including a generally straight section contained within said body member, compressing means constrained for movement in a reciprocal path along said straight section, said compressing means including a roller, means for forcing said roller in one direction against said straight section to collapse said straight section when said compressing means is moved from a first position nearer said inlet opening to a second position nearer said outlet opening, said forcing means permitting the resiliency of said straight section to cause said roller to move in a direction opposite to said one direction when said compressing means moves from its said second position toward its said first position, means for manually moving said compressing means from said first position to said second position, and means controlled by said compressing means for relatively moving said lips in a direction to close said mouth when said compressing means is moved from its said first position toward its said second position.

21. A toy figure in accordance with claim 20 in which said means actuated by said compressing means permits the resiliency of said deformable elastomeric material to relatively move said lips in a direction to open said mouth when said compressing means moves from its said second position toward its said first position.

22. A toy figure in accordance with claim 21 including means for preventing deformation of one of said lips so that only the other of said lips is moved to open and close said mouth.

* * * * *